United States Patent [19]

Körfgen et al.

[11] Patent Number: 4,614,449

[45] Date of Patent: Sep. 30, 1986

[54] WATER-DISPENSING CLEANING BRUSH WITH DEFLECTING MEANS

[75] Inventors: Harald Körfgen, Hagen; Werner Geipel, Iserlohn; Bruno Heimann, Fröndenberg-Ardey, all of Fed. Rep. of Germany

[73] Assignee: Friedrich Grohe Armaturenfabrik GmbH & Co., Hemer, Fed. Rep. of Germany

[21] Appl. No.: 643,997

[22] Filed: Aug. 23, 1984

[30] Foreign Application Priority Data

Aug. 24, 1983 [DE] Fed. Rep. of Germany ..... 3330487

[51] Int. Cl.[4] ..... A46B 11/00; A46B 11/06

[52] U.S. Cl. ..... 401/287; 15/104.9; 401/15; 401/284; 401/288; 401/289

[58] Field of Search ..... 401/289, 290, 284, 282, 401/286, 288, 15, 136, 270, 278, 279, 280, 281, 287; 15/104.9

[56] References Cited

U.S. PATENT DOCUMENTS

| | | | |
|---|---|---|---|
| 299,144 | 5/1884 | Huntbatch | 401/15 |
| 555,570 | 3/1896 | Finney | 134/183 X |
| 906,451 | 12/1908 | Murray | 401/281 |
| 1,142,911 | 6/1915 | Riddiford | 401/289 |
| 1,217,597 | 2/1917 | Hecht et al. | 401/289 X |
| 1,314,441 | 8/1919 | Stensrud | 401/136 |
| 1,372,308 | 3/1921 | MacRae . | |
| 1,731,339 | 10/1929 | Hemple | 401/288 |

FOREIGN PATENT DOCUMENTS

| | | | |
|---|---|---|---|
| 25340 | 6/1883 | Fed. Rep. of Germany . | |
| 135249 | 1/1901 | Fed. Rep. of Germany . | |
| 417646 | 8/1925 | Fed. Rep. of Germany . | |
| 1643968 | 7/1952 | Fed. Rep. of Germany . | |
| 1655379 | 7/1952 | Fed. Rep. of Germany . | |
| 848346 | 9/1952 | Fed. Rep. of Germany . | |
| 884946 | 7/1953 | Fed. Rep. of Germany | 401/288 |
| 1657181 | 2/1971 | Fed. Rep. of Germany . | |
| 2614172 | 10/1977 | Fed. Rep. of Germany . | |
| 559721 | 9/1923 | France | 401/289 |
| 738714 | 12/1932 | France . | |
| 165116 | 11/1933 | Switzerland | 401/289 |
| 1974 | of 1862 | United Kingdom | 134/167 R |
| 1453028 | 10/1976 | United Kingdom . | |

*Primary Examiner*—Steven A. Bratlie

*Attorney, Agent, or Firm*—Karl F. Ross; Herbert Dubno

[57] ABSTRACT

A brush for cleaning articles like bottles includes a hollow handle and a brush body connected to the latter and having a plurality of bristles. The brush body accommodates a passage through which the fluid flows and is provided with a plurality of slots radially extending from the passage in one plane. Cooperating with the slots is a deflector which has a rim portion extending beyond the plane of the slots so that the fluid after flowing through the handle and the passage is discharged through the slots and deflected onto the bristles at an acute angle with respect to the center axis of the brush.

6 Claims, 4 Drawing Figures

WATER-DISPENSING CLEANING BRUSH WITH DEFLECTING MEANS

FIELD OF THE INVENTION

Our present invention relates to a cleaning brush and, more particularly to a brush through which water flows for cleaning containers like bottles.

BACKGROUND OF THE INVENTION

The German utility model No. 1 643 968 describes a hand spray which has a head portion provided with an annular brush screwed thereon. Between the bristles of the brush a plurality of slots are arranged through which the water flows onto the bristles to sprinkle the article to be cleaned and to wash away any particles adhering to the bristles.

In the German utility model No. 1 655 379, there is also shown a hand spray having a head portion which is provided with a plurality of bristles. The head portion has a central opening through which the water is discharged. Since the bristles are arranged along the periphery of the head portion and thus surrounds the central opening at a certain distance, the water is, however, not directly being sprayed thereon.

In both these references, the water is discharged axially through the slots or central opening and flows parallel along the bristles. Especially when the water flows under high pressure the obtained water jets will not wet or flush the bristles thus diminishing the cleaning effect of the bristles and obtaining an undesired splashing. Moreover, since the bristles are arranged only at the head portion in axial direction, these hand sprays are not suitable for cleaning containers, especially bottles, as the side walls thereof can only insufficiently be purified from contaminations.

There are known, however, cleaning brushes having a hollow handle and a brush body which is provided with a plurality of bristles and includes radial openings so that the water is discharged radially onto the bristles and parallel thereto. Although these cleaning brushes may be usable for cleaning bottles, they have, however, the same disadvantage as above mentioned namely that upon water flow under high pressure the bristles will not be flushed or wetted thus reducing the cleaning effect and an undesired splashing will occur so that the use of the brush is impaired.

OBJECT OF THE INVENTION

It is thus the object of my present invention to provide an improved cleaning brush obviating the aforestated drawbacks.

SUMMARY OF THE INVENTION

This object, and others which will become apparent hereafter are attained, in accordance with the present invention, by providing the cleaning brush with a brush body which includes a plurality of radial slots communicating with a rim portion of an end cap fixed to the brush body in such a manner that the water flows out of the slots and is deflected at an acute angle relative to the center axis of the cleaning brush onto the bristles of the brush body.

Consequently, even when the water flows under high pressure through the brush and the slots, the bristles will always be wetted and flushed at a high rate thus guaranteeing the cleaning effect of the bristles as well as of the article e.g. a bottle.

According to a further feature of our invention, the brush body may consist of a plurality of individual portions depending on the requested length of the cleaning brush. The individual portions are connected to each other via a respective screw joint or bayonet coupling whereby always two of the portions cooperate with each other such that one of the portions includes the slots while the other of the portions is provided with the rim portion. Consequently, even with long brushes, the bristles of each portion are wetted because the water is deflected at the junction between two portions.

BRIEF DESCRIPTION OF THE DRAWING

The above and other features of our present invention will now be described in detail with reference to the accompanying drawing in which.

SPECIFIC DESCRIPTION

Figure 1:
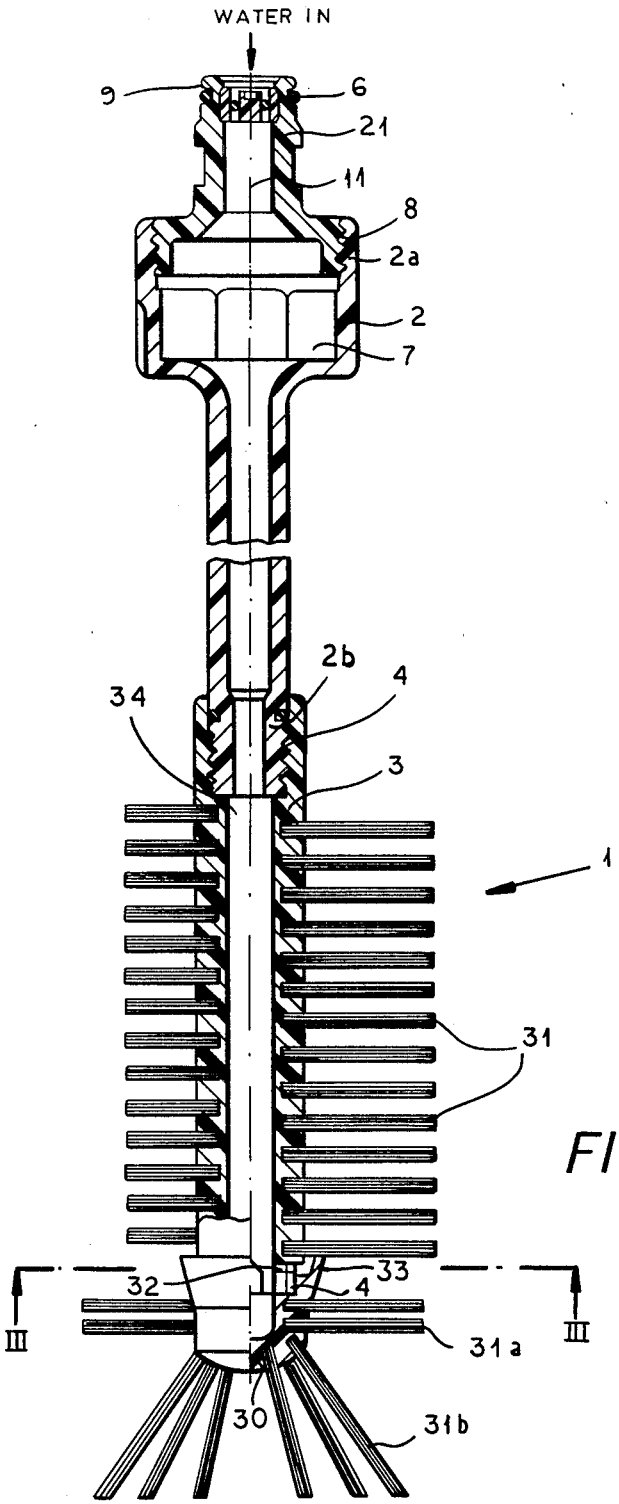
FIG. 1 is a first embodiment of a cleaning brush according to the invention.

In FIG. 1, we have shown a cleaning brush 1 having an elongated hollow handle 2 whose one end **2*a* widens in form of a cup to allow fastening of a connecting piece 21 therein. The connecting piece 21 is screwed into a nut 7 located within the cup 2*a* and rests tightly in a recess 8 of the cup 2*a* when being assembled with the latter. A tube (not shown) is pulled over the connecting piece 21 to provide communication between a water source (not shown) and the hollow handle 2 of the cleaning brush 1. To avoid leakage of water, the connecting piece 21 is provided with a recess 9 in which a sealing ring 6 is disposed to seal the tube against the connecting piece 21**.

Figure 3:
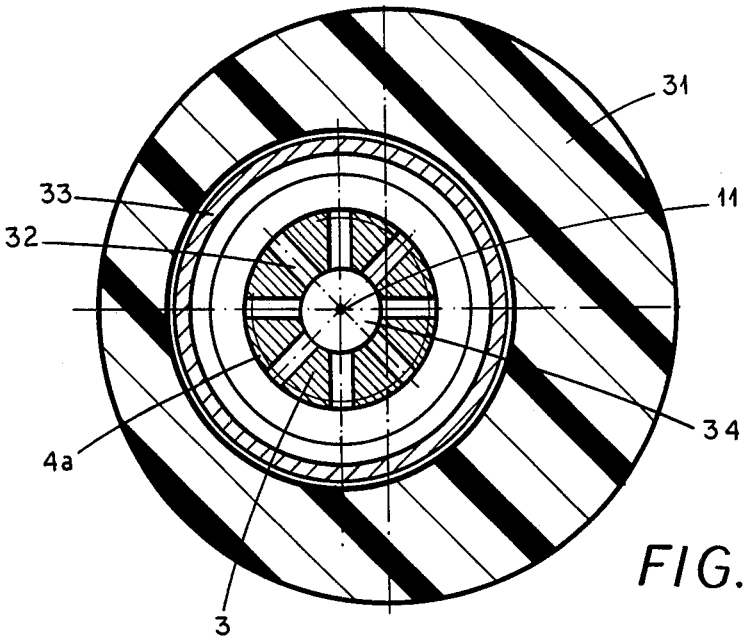
FIG. 3 is a sectional view taken along line III—III of FIG. 1.

The other end **2*b* of the handle 2 is connected to the upper portion of an elongated brush body 3 via a screw joint 4. The brush body 3 accommodates a passage 34 extending coaxial to the passage within the hollow handle 2. Radially projecting from the brush body 3 are a plurality of bristles 31 which are arranged e.g. in a helical manner. At its lower portion, the brush body 3 is provided with a plurality of slots 32 which extend radially in one plane in a star-shaped manner and are in communication with the passage 34 as is shown in FIG. 3. The water is thus supplied from the water source through the tube into the connecting piece 21 and then flows through the hollow handle 2 and the passage 34 to the slots 32** from where the water is discharged in a manner to be described now.

As shown in FIG. 1, a cup-shaped end cap 30 is connected via a screw joint **4*a* to the lower portion of the brush body 3 at a location below the slots 32. The end cap 30 which is provided with radially projecting bristles 31*a* as well as downwardly extending bristles 31*b* has a generally frustoconical rim portion 33 which projects outwardly at an obtuse angle from the remaining portion of the cap 30. The rim portion 33 extends beyond the plane of the slots 32 at a distance thereto so that a L-shaped outlet is obtained. Consequently, the water which is discharged through the slots 32 and the L-shaped outlet will be deflected and impinges the bristles 31 at an acute angle relative to the center axis 11 of the cleaning brush 1. Thus a splashing of water is prevented and an optimum cleaning effect of the bristles and the articles is obtained. We may note that it is certainly possible to provide the end cap 30 in one piece with the brush body 3 or to provide any suitable connection therebetween other than a screw joint as will be shown in connection with FIG. 2**, for example.

Figure 2:
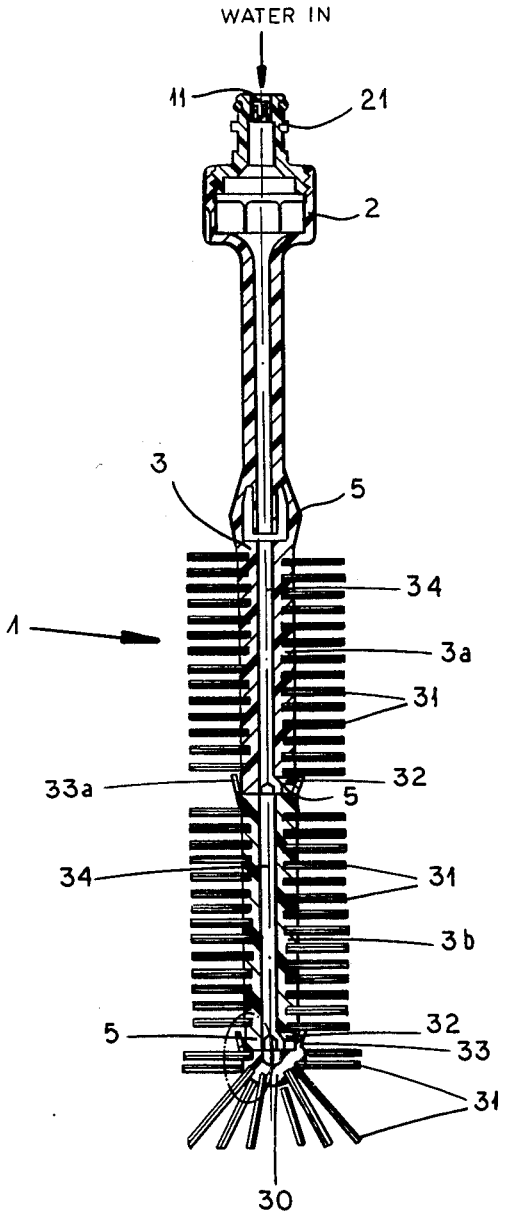
FIG. 2 is a second embodiment of the cleaning brush according to the invention.

In FIG. 2, we have used similar reference numerals for equivalent parts as illustrated in FIG. 1. In this embodiment, the handle 2 is connected to the brush body 3 which is composed of several portions—in the present embodiment two such portions 3*a*, 3*b* and an end cap 30 are provided. The connection between the upper portion 3*a* and the handle 2 as well as between the upper and lower portions 3*a* and 3*b* and between the lower portion 3*b* and the end cap 30 is obtained via a bayonet coupling 5, respectively.

Figure 4:
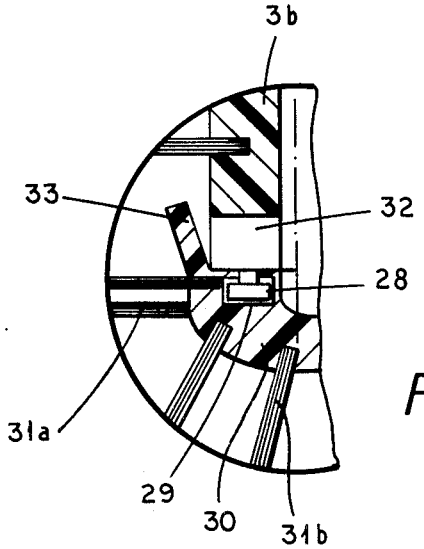
FIG. 4 illustrates on an enlarged scale the portion encircled in FIG. 2.

In FIG. 4, an exemplified bayonet coupling is shown in detail. Accordingly, at least two pins 29—only one is illustrated—integral with the brush body portion 3*b* extend radially therefrom and engage in respective grooves 28 arranged in the rim portion 33 at a location below the slots 32 so that a firm locking of the respective parts is obtained.

The embodiment according to FIG. 2 illustrates the possibility to adapt the cleaning brush 1 in its length to any size of e.g. a bottle by changing the number of brush body portions 3*a*, 3*b* etc. accordingly. Since each portion 3*a*, 3*b* is provided with an individual set of bristles 31, we arrange the slots 32 at one end of the associated portion—in the present case portion 3*a*—and to provide the portion 3*b* which is connected to the portion 3*a* via e.g. a bayonet coupling with a rim 33*a* projecting beyond the slots at an obtuse angle so that each set of bristles is sufficiently sprinkled by water at an acute angle with respect to the center axis 11 of the cleaning brush.

We claim:

1. A brush for cleaning articles, comprising:

a hollow handle communicating with a fluid source and defining a handle axis; and a brush body connected to said handle and formed with a passage for a fluid from said source, said brush body being provided with an array of radial bristles surrounding and along said axis, and deflecting means for directing the fluid out of said passage onto said bristles at an acute angle with respect to said axis, said brush body being provided with a plurality of slots radially extending from said passage in one plane, said deflecting means having a generally frustoconical rim portion outwardly of the body projecting beyond said plane of said slots and diverging outwardly in the direction of said array of bristles so that the fluid flowing through said hollow handle and said passage is discharged through said slots and deflected by said rim portion toward said bristles at an acute angle.

2. A brush as defined in claim 1 wherein said brush body is composed of separate portions connectable with each other and each provided with an individual set of bristles, adjacent pairs of said portions cooperating with each other in such manner that one of said portions accommodates said radial slots while the other of said portions is provided with said rim portion so that each set of bristles of the associated one of said portions is flushed by the fluid.

3. A brush as defined in claim 2 wherein said portions are connected to each other by means of a screw joint.

4. A brush as defined in claim 2 wherein said portions are connected to each other by means of a bayonet coupling.

5. A brush as defined in claim 1 wherein said handle is connected to said brush body by means of a screw joint.

6. A brush as defined in claim 1 wherein said handle is connected to said brush body by means of a bayonet coupling.

* * * * *